United States Patent [19]

Vogel et al.

[11] Patent Number: 5,047,065

[45] Date of Patent: Sep. 10, 1991

[54] AQUEOUS FINISHING AGENT AND PROCESS FOR A SOFT HAND, WATER AND OIL REPELLENT TREATMENT FOR FIBROUS MATERIALS: PERFLUORO-ALIPHATIC AGENT, POLYETHYLENE AND MODIFIED HYDROGEN-ALKYL-POLYSILOXANE

[75] Inventors: Hans-Burkhardt Vogel, Augsburg; Franz Mosch, Gessertshausen; Erich K. Rossler, Stadtbergen-Leitershofen; Michael A. Bernheim, Aystetten, all of Fed. Rep. of Germany; Johan E. De Witte, Borgerhout; Rudolf J. Dams, Zwijndrecht, both of Belgium

[73] Assignee: Minnesota Mining and Manufacturing Company, St. Paul, Minn.

[21] Appl. No.: 523,174

[22] Filed: May 15, 1990

Related U.S. Application Data

[63] Continuation of Ser. No. 259,875, Oct. 19, 1988, abandoned.

[30] Foreign Application Priority Data

Nov. 6, 1987 [DE] Fed. Rep. of Germany ..... 3737753

[51] Int. Cl.[5] ..... C08L 23/06; C08L 83/04; D06M 13/36; D06M 15/57

[52] U.S. Cl. ..... 8/115.6; 8/115.64; 252/8.6; 252/8.8; 252/8.9

[58] Field of Search ..... 252/8.8; 8/115.6, 115.64

[56] References Cited

U.S. PATENT DOCUMENTS

| | | | |
|---|---|---|---|
| 3,968,066 | 7/1976 | Mueller | 260/29.2 |
| 3,904,661 | 9/1975 | Pusch | 260/404.5 |
| 4,004,059 | 1/1977 | Deiner et al. | 428/224 |
| 4,054,592 | 10/1977 | Dear et al. | 560/25 |
| 4,211,815 | 7/1980 | Deiner | 427/387 |
| 4,215,205 | 7/1980 | Landucci | 252/8.7 |
| 4,477,498 | 10/1984 | Deiner et al. | 427/389.9 |
| 4,540,479 | 9/1985 | Sakurai et al. | 204/427 |
| 4,606,737 | 8/1986 | Stern | 8/115.6 |
| 4,624,889 | 11/1986 | Bries | 252/8.6 |
| 4,625,010 | 11/1986 | Huhn et al. | 528/31 |
| 4,668,406 | 5/1987 | Chang | 252/8.75 |
| 4,668,726 | 5/1987 | Chang | 252/8.75 |
| 4,668,726 | 5/1987 | Howells | 252/8.6 |

FOREIGN PATENT DOCUMENTS

| | | |
|---|---|---|
| 5829 | 12/1979 | European Pat. Off. . |
| 3435618 | 4/1986 | Fed. Rep. of Germany . |

*Primary Examiner*—A. Lionel Clingman

*Attorney, Agent, or Firm*—Gary L. Griswold; Walter N. Kirn; Carole Truesdale

[57] ABSTRACT

An aqueous finishing agent for providing fibrous materials with a soft water and oil repellent treatment is provided. The finishing agent comprises A) 25 to 65% by weight of a perfluoroaliphatic group-bearing water/oil-repellent agent (at least 5% by weight fluorine) in dispersion, B) 10 to 35% by weight of a dispersion of an emulsifiable polyethylene (density at 20° C. at least 0.92 g/cm$^3$, acid number at least 5) and C) 25 to 40% by weight of a fluorine-free dispersion of a soft-hand extender based on a modified hydrogen alkyl polysiloxane. A process for providing fibrous materials with a soft water and oil repellent treatment is also provided. The finishing agent provides fibrous material with excellent properties which are resistant to washing and dry cleaning and a particularly smooth, soft hand.

12 Claims, No Drawings

AQUEOUS FINISHING AGENT AND PROCESS FOR A SOFT HAND, WATER AND OIL REPELLENT TREATMENT FOR FIBROUS MATERIALS: PERFLUORO-ALIPHATIC AGENT, POLYETHYLENE AND MODIFIED HYDROGEN-ALKYL-POLYSILOXANE

This is a continuation of application Ser. No. 07,259,875 filed Oct. 19, 1988, now abandoned.

The present invention relates to aqueous finishing agents for a soft hand water and oil repellent treatment for fibrous materials based on perfluoroaliphatic compositions and extenders and also to a process for providing a soft hand water and oil repellent treatment to fibrous materials.

Water-, oil- and soil-repellent finishes containing fluorochemical agents or compositions has been known for a long time (see Chwala/Anger "Handbuch der Textihilfsmittel", 1977, Verlag Chemie, Weinheim, pages 470 ff). A considerable disadvantage of these finishes is their high price. For this reason so-called extenders have been developed, in order to first of all reduce the costs of these finishes and, moreover, to obtain improvements with regard to hand. At first, metal salts containing paraffin emulsions, fatty-modified synthetic resins, waxes and similar products were used for this purpose, but none of them was satisfactory with respect to the overall performance. The addition products of olefins, vinyl- and allyl esters of aliphatic straight chain or branched chain acids and other materials to hydrogen polysiloxanes (U.S. Pat. No. 4,004,059) which were later developed, brought an improvement of the water- and oil-repellency, but however, were not sufficiently permanent and did not meet the requirements, above all with regard to the desired soft-hand effect.

Now finishing agents have been found which can be used for the simultaneous, especially smooth and soft hand, water and oil repellent treatment for fibrous materials. These finishing agents contain perfluoroaliphatic group-bearing water and oil repellent agents, selected polyethylene emulsions and fluorine-free soft-hand extender emulsions in selected proportions.

The finishing agents of this invention, i.e., the perfluoroaliphatic group-bearing agent, the polyethylene emulsion, and the fluorine-free polysiloxane soft-hand extender, can be provided as a ready-made pre-mixed formulation or they can be individually added to a finishing bath.

In this way finishing agents result which surprisingly, provide very good oil and water repellent properties which have excellent resistance to laundry and dry cleaning and a particularly smooth, soft hand.

Component A) are perfluoroaliphatic group-bearing water and oil repellent agents many of which are commercially available and which contain in the ready-made formulation at least 5% by weight, preferably 5.5 to 15% by weight, more preferably 7 to 12% by weight of fluorine in dispersion, based on the weight of the dispersion. The perfluoroaliphatic group, $R_f$, can be straight chain, branched chain, or if sufficiently large, cyclic, or combinations thereof. The skeletal chain in the perfluoroaliphatic radical can include catenary oxygen and/or trivalent nitrogen hetero atoms bonded only to carbon atoms. These types of fluorochemical agents are well-known to those skilled in the art.

Examples of such perfluoroaliphatic group-bearing water and oil repellent agents include those formed by the reaction of perfluoroaliphatic thioglycols with diisocyanates to provide perfluoroaliphatic group-bearing polyurethanes. These products are normally applied as aqueous dispersions for fiber treatment. Such reaction products are described, for example, U.S. Pat. No. 4,054,592, which is incorporated herein by reference. Another group of compounds which can be used as component A) are perfluoroaliphatic group bearing N-methylol condensation products. These compounds are described in the U.S. Pat. No. 4,477,498 which is incorporated herein by reference, where the emulsification of such products is dealt with in detail.

A further group of compounds which can be used as component A) are perfluoroaliphatic group- ($R_f$group-) bearing polycarbodiimides which can be obtained by, for example, reaction of perfluoroaliphatic sulfonamide alkanols with polyisocyanates in the presence of suitable catalysts. This class of compounds can be used alone, but often is used with other $R_f$group-bearing compounds, particularly with (Co)polymers. Thus another group of compounds which can be used in dispersions as component A) is mentioned. Among these compounds all known polymers bearing fluoroaliphatic residues can be used, also condensation polymers, such as polyesters and polyamides which contain the corresponding perfluoroaliphatic groups, comes into consideration, but above all, (co)polymers based on, e.g., $R_f$-acrylates and $R_f$-methacrylates, which can contain different fluorine-free vinyl compounds as comonomers. In German Patent Publication No. DE-A 2 310 801 (see also British Patent Publication No. GB-A 1.413.051/052) these compounds are discussed in detail. The manufacture of $R_f$group- bearing polycarbodiimides as well as the combination of these compounds with each other is described in detail, too.

Besides the aforementioned perfluoroaliphatic group-bearing agents further fluorochemical components may be used as component A), for examples $R_f$-group-bearing guanidines (U.S. Pat. No. 4,540,479), $R_f$-group-bearing allophanates (U.S. Pat. No. 4,606,737) and $R_f$-group-bearing biurets (U.S. Pat. No. 4,668,406), which are incorporated herein by reference. These classes of components A) are mostly used in combination.

As can be learned from the entire literature, the active compounds of component A) show, in general, one or more perfluoroaliphatic residues with preferably at least 4, especially 6 to 14 carbon atoms each. Component A) is applied in the finishing agents according to the invention in quantities of 25 to 65% by weight based on the weight of the finishing agent. As the components A) preferably contain about 7 to 12% by weight of fluorine, agents which contain 30 to 55% by weight of these components, are particularly suitable.

The emulsifiable polyethylene (polyethylene wax) useful as component B) is well-known and described in, for example, German Patent Publication Nos. DE-PS 2 359 966, DE-AS 2 824 716 and DE-AS 1 925 933. In general, the emulsifiable polyethylenes contain functional groups, preferably COOH-groups, which may partly be esterified. These functional groups are introduced by oxidation of the polyethylene. It is, however, also possible to maintain the functionality by copolymerization of ethylene with e.g., acrylic acid. The emulsifiable polyethylenes useful as component B) have, at 20° C., a density of at least 0.92 g/cm$^3$ and an acid number of at least 5. According to the invention, such emulsifiable polyethylenes are especially preferred which have a density at 20° C. of 0.95 to 1.05 g/cm$^3$, an acid number of 10 to 60 and a saponification number of 15 to 80. This material is, in general, commercially available in the form of flakes, pastilles and the like.

Component B), i.e. the dispersion of the emulsifiable polyethylene, is applied in the finishing agents in quantities of 10 to 35% by weight based on the weight of the finishing agent and to a 20 to 35% dispersion (referring to polyethylene wax). The hand of fibrous materials can be made even more pleasant, smoother, and softer by using higher quantities of component B) so that quantities of 20 to.35% by weight of component B), based on the weight of the finishing agent, are particularly preferred.

The polyethylene wax is provided as an emulsion. Different emulsifying agents are present. These emulsifying agents may also contribute to the soft-hand effect of the finishing agent.

As component C) modified hydrogen alkyl polysiloxanes are suitable and can be provided in the form of aqueous dispersions. As fluorine-free, soft hand extenders such compounds are those which are obtained by modification of hydrogen methyl polysiloxane with a long-chain alkyl residue. This alkyl residue should contain at least 8 C-atoms on average, especially 8 to 18 C-atoms. Low chain alkyl residues may also present, but the average C- chain length should be at least 8 carbon atoms. Such compounds are described in U.S. Pat. No. 4,004,059. Quite particularly, components C) are preferred which are further modified, i.e., which contain, beside the above-named groups, additional epoxy alkyl groups and which may, in addition contain aryl, particularly phenyl, groups in the molecule as disclosed in U.S. Pat. No. 4,625,010). Such compounds have a Si-H-content of about 0.02 to 6, especially 0.3 to 1.8% by weight, an epoxide number of about 0.01 to 0.06 and, moreover, per g atom hydrogen of the siloxane at least 0.2 g atom are substituted by an alkyl residue (see above).

The components C) are present on average as 25 to 40% dispersions and, referring to these dispersions, from component C) 25 to 40% by weight, especially 25 to 35% by weight based on the weight of the finishing agents, are used.

These components C) are obtained, as well as the components A) and B) in the known manner (see literature cited). With regard to the emulsifiers there exist for the dispersing and the dispersion polymerization process respectively, no restrictions in principle, i.e., nonionic and usual cationic and anionic emulsifiers can be used. But due to the fact that the finished dispersions, i.e., the components A), B) and C) are mixed during the production of the finishing agent according to the invention and, moreover, are frequently used in combination with other components, it is preferred to use during the manufacture more or less nonionic or only weakly cationic emulsifiers, in order to keep the hazard of mutual influences as small as possible. The usable emulsifiers are well-known to those skilled in the art. The emulsifiers are applied in usual quantities. In general, the quantity of emulsifier is 3 to 50, preferably 8 to 40, percent by weight, referring to the dispersed substance.

The manufacture of the finishing agents is performed by mixing the components A), B) and C) in the indicated quantities. These agents have the advantage that they provide a stable one-part finishing agent.

For the process of the soft water/oil-repellent treatment of fiber materials the agents produced in this way are applied directly. The used quantities depend on the required effects and usually are applied 40 to 100, especially 50 to 80 g/l, referring to a 25 to 35% by weight finishing agent.

The utilization of the agents according to the invention is, as already mentioned above, preferably used as a one-part finishing agent, but within the scope of the present process it is also possible to prepare, with the corresponding quantities of components A), B) and C) the usual aqueous finishing baths and those skilled in the art can readily achieve the desired excellent total effects.

In the present process, auxiliary agents commonly used in the textile industry can be added to the above-mentioned finishing bath. In this connection, crease-resistant agents can be added to provide not only the desired crease-resistance, but, in addition, further stabilization of the effects is obtained. An aminoplast resin can also be added to the bath in an amount of 10 to 45 g/l of a 40 to 60% solution. Also, filling resins, flame-proofing agents, anti-slip agents, and similar products, as well as any catalysts which are also necessary, can be used as additional agents, all in usual quantities.

According to the present invention fibrous materials of all types can be finished. As fibrous materials, textile materials are preferred. Those textiles which consist of cellulose fibers or at least partly contain cellulose fibers are especially preferred. As additional fibers, beside cellulose, both synthetic fibers, such as polyester, polyamide or polyacrylonitrile fibers and other natural fibers such as wool come into consideration. The process according to the invention can, of course, also be used for the finish of pure synthetic fiber and woolen fiber materials. Oil and water repellent finishes on cotton/-polyester-mixed fibers is especially critical and the finishing agents according to the invention particularly show their superiority over the prior art finishes on such blends.

The advantages of the present invention over the prior art are less apparent in oil and water repellent properties. But the wash- and dry-cleaning permanencies demonstrate remarkable advantages over the prior art, e.g., U.S. Pat. No. 4,004,059.

The significant superiority of the present invention can easily be seen when comparing the hand of fabrics treated according to the present invention. According to the prior art, it was already possible, due to the use of an extender, as described in U.S. Pat. No. 4,004,059, to obtain a good to very good silicone hand. With this known finish, the smoothness of the surface and, above all, the inner softness is not as good as is desired. With the present invention all requirements, including smoothness of the surface and inner softness, are fulfilled so that, on the whole, superior soft-hand effects can be seen. Surprisingly, by the addition of the selected component B) in the indicated quantities a further, even though small, improvement of the oil and water repellent effects, a remarkable improvement of the permanencies and, above all, a considerable positive influence of the hand can be achieved, over that provided by the silicone hand by itself which has been regarded, in general, as especially soft and smooth on the surface. Furthermore, the effect-stability of the present finishing agents is particularly advantageous.

The present invention is described in detail in the following examples, whereby parts mean parts by weight and indications in percent are percent by weight.

EXAMPLE 1

For obtaining Finishing Agent I the following components were mixed together.

Component A 1)

55 parts of a dispersion (emulsifier: polyethoxylated quaternary ammonium salt) consisting of polymer X (see DE-A 2 310 801) and $R_f$-polycarbodiimide-emulsion (see Example 1, DE-A 2 310 801) in a weight ratio of 2:1.

Polymer X can be prepared by heating a reaction mixture of 90 parts $C_8F_{17}SO_2N(CH_3)C_2H_4OOCC(CH_3)=CH_2$, and 10 parts butylacrylate in 160 parts water and 40 parts acetone with 0.2 parts t-dodecyl mercaptan and 0.2 parts potassium persulfate using 5 parts of a commercial polyethoxylated quaternary ammonium chloride emulsifier at 65° C. for 16 hours.

The $R_f$-polycarbodiimide-emulsion can be prepared as follows:

A solution of 101.6 parts (0.17 mol) $C_8F_{17}SO_2N(CH_2CH_2OH)_2$ in 265 parts methyl isobutyl ketone (MIBK) is dried by distilling off 30 parts of the solvent. Then 54 parts (0.31 mol) 2,4-toluene diisocyanate are added and the solution is held for 2 hours under reflux. During this time, a prepolymer is formed from the diisocyanate. This solution is then cooled to 65°–75° C. and 1 part 3-methyl-1-phenyl-3-phospholine-1-oxide is added. Then, the reaction mixture is refluxed for 3 additional hours. A film prepared from this solution is weak and brittle and gives in infrared a peak characteristic for carbodiimide at 4.69 micrometers. This solution contains the carbodiimide Polymer A with the following structure:

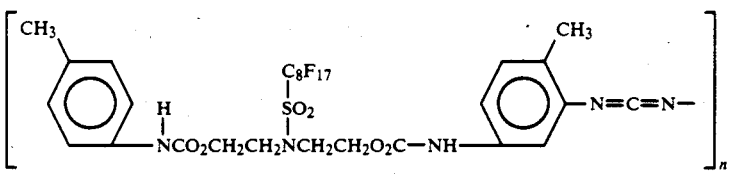

To 100 parts of this polycarbodiimide in 121 parts MIBK are added 4 parts polyoxyethylene sorbitan monooleate and 4 parts $C_8F_{17}SO_2N(CH_3)C_2H_4N(CH_3)_3Cl$ as emulsifiers and 225 parts of distilled water were added. This mixture is emulsified by using a high-speed mixer.

Component B 1)

20 parts of a commercial, non-ionic, finely dispersed, aqueous 20% polyethylene wax dispersion (50% nonylphenol ethoxylated with an average of 15 moles ethylene oxide, referring to polyethylene wax, as emulsifier; polyethylene wax with a density at 20° C. of about 1, an acid number of about 13 and a saponification number of about 22).

Component C 1)

35 parts of an aqueous, non-ionic (emulsifier: 3% of a $C_{10}$–$C_{12}$-fatty alcohol ethoxylated with 6 moles ethylene oxide) 35% soft-hand extender dispersion (H- and epoxy functional aryl-methyl-$C_{12}$-alkyl-polysiloxane with the following data: viscosity (25° C.) about 1350 mPa.s, refractive index $n_D^{25}$ 1,460–1,465, Si-H-content about 1% by weight, epoxide number about 0.03, ratio of the 2-phenyl-propyl-residues to $C_{12}$-alkyl residues about 1:5, no dimethyl-Si-groups).

Bath I

With this Finishing Agent I an aqueous finishing bath is prepared as follows:

60 g/l Finishing Agent I 40 g/l of an about 60% solution of aminoplast resin (contains dimethylol-dihydroxy-ethylene urea and pentamethylol melamine both etherified with methanol in a ratio of 12:1 and about 5% neutral salt), 6 g/l of a 30% zinc nitrate solution (pH-value about 1.0) and 2 g/l 60% acetic acid.

Bath II

Like bath I, instead of the Finishing Agent I the components A 1) to C 1) being added to the bath separately, but in equivalent quantities.

Bath III

Like bath II, but with twice the amount of component B 1).

Bath IV (comparison)

Like Bath II, but without component B 1).

Bath V (comparison)

Like bath II, but instead of component C 1) the same amount of an α,ω-dihydroxy-polydimethylsiloxane (viscosity 20° C.): ca. 5000 mPa.s) in aqueous dispersion is used.

Finish

With baths I to V a polyester/cotton coat poplin 67/33 (about 210 g/cm³) was padded (pick up about 65%), then dried at 110° C. for 10 minutes and cured at 150° C. for 5 minutes.

The finished fabrics were tested for oil and water repellency and after washing and dry cleaning after a 5-day exposure to normal climate. The washes are usual 40° C. household machine washes and the dry cleanings (DC) were performed in the presence of 2 g/l of a usual detergent and 2 g/l water (bath proportion 1:10). The oil repellency test was made according to AATCC. 118-1972, the water-repellency test according to DIN 53888 (a = water absorption in percent; b = water-repellent effect) and according to the Spray test procedure corresponding to AATCC. 22-1974, respectively. The fabrics were also evaluated for hand. The results are set forth in Table I. As can be seen from the data in Table I the finishes according to the invention are, with regard to the effects, but above all with regard to the soft hand, significantly superior to the comparative finishes.

TABLE I

| | Original | | | | 5 × 40° C.-washing | | | | 1 × DC | | | | |
|---|---|---|---|---|---|---|---|---|---|---|---|---|---|
| | a | b | Spray Oil | | a | b | Spray Oil | | a | b | Spray Oil | | Hand |
| Bath I | 8 | 4 | 100 | 4–5 | 6 | 5 | 100 | 4 | 25 | 5 | 100 | 4 | internally particularly |
| | | 4 | | | | 5 | | | | 3 | | | soft and rich with a |
| | | 4 | | | | 5 | | | | 2 | | | pleasant smoothness (very |

TABLE I-continued

| | Original | | | | 5 × 40° C.-washing | | | | 1 × DC | | | | |
|---|---|---|---|---|---|---|---|---|---|---|---|---|---|
| | a | b | Spray | Oil | a | b | Spray | Oil | a | b | Spray | Oil | Hand |
| | | | | | | | | | | | | | good soft-hand effect) |
| Bath II | 7 | 5<br>5<br>5 | 100 | 4–5 | 7 | 5<br>5<br>5 | 100 | 4 | 28 | 4<br>2<br>2 | 100 | 4 | approximately like above |
| Bath III | 9 | 5<br>5<br>5 | 100 | 4–5 | 10 | 5<br>5<br>5 | 100 | 4 | 26 | 4<br>3<br>2 | 100 | 4 | internally outstandingly soft with a pleasant richness and surface smoothness (excellent soft-hand effect) |
| Bath IV (comparison) | 14 | 4<br>4<br>3 | 100 | 4–5 | 13 | 4<br>3<br>3 | 100 | 3 | 28 | 4<br>2<br>2 | 90 | 3 | soft and smooth |
| Bath V (comparison) | 9 | 4<br>4<br>3 | 100 | 1 | 11 | 4<br>3<br>2 | 100 | 0 | 26 | 4<br>2<br>2 | 90 | 0 | particularly soft hand with good surface smoothness |
| Untreated | 85 | 1 | 0 | 0 | | — | | | | | — | | — |

EXAMPLE 2

For obtaining Finishing Agent II, the following components were mixed together:

Component A 2)

40 parts of a formulation corresponding to example 1 of the PCT Application WO 86/02115 (about 6% fluorine).

In Example 1 of PCT Application No. 86/02115, a low molecular weight blocked polyurethane is synthesized, emulsified with a perfluoro-modified polyurethane, and blended with an emulsion of a perfluoroalkyl-modified methylolmelamine ethers.

The low molecular weight blocked polyurethane is prepared as follows:

30 g of 75% solution of the reaction product of 3 moles toluene diisocyanate and 1 mole trimethylolpropane (average mole. wt. about 850) in ethyl acetate are dissolved in 67 g methyl isobutyl ketone. To this solution 7.0 g butanone oxime are added, with a temperature increase of 60° to 70° C. At this temperature, the reaction is stirred for twenty minutes. An IR- spectrum is taken to determine whether an —NCO absorption is present. As long as this absorption is present, 0.1 g of butanone oxime is added in small portions until no —NCO groups can be detected.

The perfluoro-modified urethane is prepared according to U.S. Pat. No. 3,968,066, Example 8, as follows:

Methyl ethyl ketone (600 g) was charged to a 2 l. flask fitted with a stirrer, thermometer, nitrogen inlet and a condenser protected with a drying tube. 2,3-Bis-(1,1,2,2-tetrahydroperfluoroalkylthio)butane-1,4-diol (600 g; 0.571 mole) was added together with a 1:1 mixture of 2,2,4-trimethylhexamethylene diisocyanate and 2,4,4-trimethylhexamethylenediisocyanate (80.16 g; 0.381 mole). All reagents were rinsed in with an additional 50 g MEK. The solution was heated to boiling and 50 g solvent was removed by distillation to effect azeotropic drying of all materials. The dibutyl tin dilaurate (0.692 g; 1.14×10< − 3 > mole; 2 mole % based on diol) was added as a catalyst and the solution was heated under reflux for 6 hours, when the reaction was judged to be complete by the absence of the N=C=O infrared band at 2270 cm< − 1>. The solution was cooled to room temperature (25°) and diluted with MEK to a total of 2042 g (33 1/3% solids). A portion of the above material was taken to dryness. A quantitative recovery of a resinous material was obtained. Elemental analysis showed 52.8% F. (theory: 53.4% F.). Infrared bands at 3460 cm< − 1> (O-H str.), 3340 cm< −1 > (N-H str.) and 1705 cm< − 1 > (C=0 str.) confirmed the structure of the hydroxy-terminated urethane prepolymer.

The thus-prepared hydroxy-terminated prepolymer (53.7 g solution, 17.9 g solids) was treated further at 75° with dimer acid derived diisocyanate (6.0 g; 0.01 mole) (DDI, General Mills Co.) for 2 hours, then the urethane chain was completed by the addition of trimethylhexamethylene diisocyanate (2,2,4 and 2,4,4 isomer mixture) (1.05 g; 0.005 mole) and N-methyldiethanolamine (0.19 g; 0.01 mole). Reaction was complete in three hours, as shown by the disappearance of the N=C, ) band (2270 cm< − 1>) in the infrared spectrum A sample taken to dryness gave a quantitative yield of an off-white powder containing 35.8% F. (theory 36.6% F.). For application to textile fabrics the polyurethane was applied either from solvent (MEK solution) or as an aqueous emulsion. The latter was made by first quaternizing the tertiary nitrogen atoms with glacial acetic acid and then pouring the MEK solution into a sufficient volume of water to give a clear emulsion.

The perfluoroalkyl-modified methylolmelamine ether is prepared according to European Patent Publication No. 073,364, Example 1, as follows:

In a 1-liter 4-neck-flask, equipped with a stirrer, gas inlet tube, internal thermometer and distilling attachment with descending condenser and collecting flask, 233.3 g (about 0.5 mole) of $R_fCH_2CH_2SH$ ($R_f$ comprises 1.3% by weight $C_4F_9$—, 34.3% by weight ($C_6F_{13}$—, 31.8% by weight ($C_8F_{17}$—, 22.5% by weight $C_{10}F_{21}$—, 8.2% by weight $C_{12}F_{25}$— and 1.9% by weight $C_{14}F_{29}$—), 39.0 g (about 0.1 mole) of bexamethylol melamine bexamethyl ether and 0.5 g of p-toluene sulfonic acid hydrate are mixed and gradually heated to 115° C. during 30 minutes with stirring and introducing a weakly stream of nitrogen gas and then during further 90 minutes heated up to 175° C. This condition is then kept for further 6 hours while methanol with small quantities of perfluoro compounds distills off.

Thereafter, temperature is decreased to about 80° C. and the yield is fixed weighing (95% of the theory). The still-warm condensation product is dissolved in 730 g of benzotrifluoride.

500 g of the obtained solution with 25% by weight of condensation product and 1000 g water which contains 2.7% by weight of emulsifier (hydroxyalkylaminopolyglycol ether acetate with 10 moles ethylene oxide in total) are pre-emulsified in a vessel with a high speed stirrer and emulsified by high pressure homogenization at 250 bar and at 50° C. maximum. The solvent together with a part of the water are distilled off from the emulsion under reduced pressure obtainable with a water jet vacuum pump at a temperature up to 50° C. and an emulsion is obtained which contains 12.4% by weight of the condensation product.

The emulsification of the low molecular weight polyurethane with the perfluoro-modified polyurethane is carried out as follows:

97.8 g of a 50% solution of the perfluoro-modified polyurethane in butyl acetate and 1.7 g glacial acetic acid are stirred together and the mixture is heated to 70° C. In a separate flask, 8.8 g of an acetate of ethoxylated fatty amine (about 10 moles ethylene oxide per mole of fatty amine with carbon chain length of 16 to 18) and 245 g water are heated to 70° C. with stirring. To this solution is added by means of a ultrahigh speed mixer, the solution of the blocked low molecular weight polyurethane and the perfluoro-modified polyurethane are added together with very fast mixing. Then, this pre-emulsion is homogenized to the desired particle size at 70° C. by means of high pressure homogenizer at 300 bars. This emulsion is stripped of solvent by means of an azeotropic vacuum distillation at maximum 40° C. Then, using water, the product is adjusted to an end weight of 383 g. Afterwards, an additional 255 g of a 16% emulsion of perfluoralkyl-modified methylolmelamine ether is added, an emulsion is obtained with about 20 weight percent of solids, containing 4.8 weight percent of the low molecular weight polyurethane.

Component B 2)

10 parts of a commercial, non-ionic, finely dispersed 21% polyethylene wax dispersion (25% tallow fatty amine ethoxylated with 8 moles ethylene oxide, referring to polyethylene wax, as emulsifier; polyethylene wax with density about 0.96 g/cm$^3$ at 20° C., acid number 27 and saponification number about 52).

Component C 2)

40 parts of a 15%, aqueous soft-hand extender emulsion of an addition product of n-hexadecene (α-olefin with 16 C-atoms on average) to methyl hydrogen polysiloxane (mole ratio 1:2) manufactured according to U.S. Pat. No. 4,004,059 which is incorporated herein by reference (reaction in butyl acetate during a total of 1.5 hours; stabilizer: tertiary hexadecylmercaptan; emulsification as described).

With Finishing Agent II the following bath I was prepared:

90 g/l of finishing agent II 30 g/l of a 60% aqueous solution of pentamethylol melamine trimethylether, 6 g/l of the catalyst solution of Example 1 and 2 g/l of 60% acetic acid.

For obtaining Finishing Agent IIa, the components were mixed together as for Finishing Agent II except that 20 parts of Component B2 were used. Bath II was prepared in the same manner as Bath I except 100 g/l of Finishing Agent IIa, was substituted for Finishing Agent II. The textile material described in Example 1 was finished using each of the two baths as described in Example 1. The treated fabrics were tested as in Example 1 together with a comparative example in accordance with the prior art (Bath III with 80 g/l, of an agent prepared from A 2) and C 2), i.e., without the polyethylene base dispersion). The results are set forth in Table II.

TABLE II

| | Original | | | | 5 × 40° C.-washing | | | | 1 × DC | | | | |
|---|---|---|---|---|---|---|---|---|---|---|---|---|---|
| | a | b | Spray | Oil | a | b | Spray | Oil | a | b | Spray | Oil | Hand |
| Bath I | 6 | 5 | 100 | 4–5 | 5 | 5 | 100 | 4 | 26 | 5 | 100 | 4 | particularly soft, rich |
| | | 5 | | | | 5 | | | | 4 | | | hand with excellent |
| | | 5 | | | | 5 | | | | 3 | | | surface smoothness |
| Bath II | 4 | 5 | 100 | 4–5 | 4 | 5 | 100 | 4 | 24 | 5 | 100 | 4 | like bath I, with |
| | | 5 | | | | 5 | | | | 4 | | | increased softness |
| | | 5 | | | | 5 | | | | 4 | | | |
| Bath III | 7 | 5 | 100 | 4–5 | 10 | 5 | 100 | 3 | 29 | 4 | 90 | 3 | soft and smooth |
| (comparison) | | 5 | | | | 4 | | | | 3 | | | |
| | | 4 | | | | 4 | | | | 2 | | | |

EXAMPLE 3

A cotton fabric (170 g/m$^2$) was dipped into a bath containing the following components (Bath I), squeezed to a pick up of about 70%, dried at 105° C., and cured for 5 minutes at 155° C.:

40 g/l Asahi Guard AG 310 (dispersion based on perfluoroalkyl acrylate polymer with approximately 9% fluorine).

15 g/l of the polyethylene wax dispersion described in Example 1 (polyethylene wax with d(20° C.)=0.93, acid-/saponification number=16), 20 g/l of a 25%, nonionic dispersion of a soft-hand extender (H-functional methyl-$C_{10-12}$-Alkylpolysiloxane with 11 mole percent Me-Si-H-groups and 89 mole percent Me-Si-alkyl-groups, a viscosity at 25° C. of 930 mPa.s and $n_D^{25}$=1,453), 20 g/l of an aqueous, about 50% solution of pentamethylolmelaminemethylether, 20 g/l of a 45% aqueous solution of dimethylol-dihydroxy-ethylene urea, 2 g/l 60% acetic acid and 8 g/l magnesium chloride hexahydrate (bath I).

For comparative purposes, Bath II (prior art) was prepared in the same manner as Bath I except the polyethylene wax dispersion was omitted, and the cotton fabric was treated using Bath II in the same manner as described for Bath I.

The treated fabrics were tested as in Example 1. The results are set forth in Table III.

As can be seen from the data in Table III, the finish according to the invention provides the fabric with a very good permanent oil and water repellency and a very pronounced soft-hand effect. The prior art finish provides somewhat less oil and water repellency and, above all, the soft hand effect is less pronounced.

TABLE III

| | Original | | | 5 × 40° C.-washing | | | 1 × DC | | | |
|---|---|---|---|---|---|---|---|---|---|---|
| | a | b | Oil | a | b | Oil | a | b | Oil | Hand |
| Bath I | 6 | 5 | 5 | 7 | 5 | 4–5 | 23 | 4 | 4 | pronounced soft- |
| | | 5 | | | 5 | | | 3 | | hand effect |
| | | 4 | | | 4 | | | 3 | | |
| Bath II | 7 | 5 | 5 | 9 | 5 | 3–4 | 27 | 4 | 3 | moderate to good |
| (prior art) | | 4 | | | 4 | | | 2 | | soft hand |
| | | 4 | | | 4 | | | 2 | | |
| Untreated | 82 | 1 | 0 | | — | | | — | | — |

If instead of the aminoplast/catalyst system a usual antislip agent based on polysilicic acid/basic aluminum chloride (active substance about 16%) is added to this bath in quantities of 15 g/l, the resistance to slippage is improved at the same time, if, e.g., a polyester knitwear is finished.

EXAMPLE 4

In the same way as described in Example 1, Bath I, the following two silicones can be used for making component C):

| $n_D^{25}$ | viscosity (25° C.) (mPa.s) | Si—H-content (% by weight) | epoxide number |
|---|---|---|---|
| 1.453 | 1150 | about 0.04 | 0.02 |
| 1.451 | 1050 | about 0.08 | 0.05 |

The effect level of corresponding finishes is in accordance with the results indicated in Example 1.

EXAMPLE 5

The fabric described in Example 1 was dipped into a bath containing the following components, squeezed up to a wet pick up of about 55%, is dried and cured for 3 minutes at 160° C.:

32 g/l $R_f$-acrylate copolymer (cationic dispersion based on the acrylate of $C_6$-$C_{10}$-perfluoroaliphatic-N-ethyl-N-β-hydroxy-ethyl-sulfonamide with a fluorine content of about 10%), 15 g/l of a 27% polyethylene wax dispersion (polyethylene wax with d=0.98 (20° C.), acid number 25, saponification number 50; 50%, referring to the polyethylene wax, of an emulsifier mixture from $C_{16}/_{18}$-fatty alcohol ethoxylated with an average of 40 moles ethylene oxide per one mole alcohol and an emulsifier according to Example 1 of U.S. Pat. No. 3,904,661 which is incorporated by reference herein, in a ratio of 1:9) and 20 g/l of component c 1) from Example 1 of this patent application containing the modified hydrogen alkyl polysiloxane of Example 1 of U.S. Pat. No. 4,625,010 which is incorporated herein by reference, as soft hand extender (Bath I).

For comparison with the prior art, a bath was prepared in the same manner as Bath I without the polyethylene wax dispersion (Bath II).

| | Original | | | |
|---|---|---|---|---|
| | a | b | Oil | Hand |
| Bath I | 8 | 5 | 5 | excellent soft-hand- |
| (according to the | | 5 | | effect with very |
| invention) | | 4 | | good internal softness |
| Bath II | 9 | 5 | 4 | moderate soft hand |
| (prior art) | | 4 | | |
| | | 4 | | |

The durability after laundering and dry-cleaning is similar to that observed in the other examples of the invention.

The various modifications and alterations of this invention will be apparent to those skilled in the art without departing from the scope and spirit of this invention and this invention should not be restricted to that set forth herein for illustrative purposes.

We claim:

1. Aqueous finishing agent for fibrous materials comprising:

A) 25 to 65% by weight, based on the weight of the finishing agent, of an aqueous dispersion of a fluoroaliphatic group-bearing water and oil repellent compound selected from perfluoroaliphatic group-bearing polyurethanes, perfluoroaliphatic group-bearing N-methylol condensation products, perfluoroaliphatic group-bearing polycarbodiimides, perfluoroaliphatic group-bearing polymer or copolymer, perfluoroaliphatic group-bearing guanidines, perfluoroaliphatic group-bearing allophanates, perfluoroaliphatic group-bearing biurets, or combinations thereof, said compound comprising 30 to 55% by weight of said dispersion said dispersion containing at least 5% by weight fluorine, B) 10 to 35% by weight, based on the weight of the finishing agent, of an aqueous dispersion of an emulsified oxidized polyethylene with a density at 20° C. of at least 0.92 g/cm$^3$ and an acid number of at least 5, said emulsifiable polyethylene comprising 20 to 35% of said dispersion, and C) 25 to 40% by weight, based on the weight of the finishing agent, of a fluorine-free aqueous dispersion of a soft-hand extender selected from the group consisting of an H-functional $C_{8-18}$-alkyl-methyl-polysiloxane, an H- and epoxy-functional $C_{8-18}$-alkyl-methyl-polysiloxane, an H-functional $C_{8-18}$-alkyl-methyl-polysiloxane containing additional aryl groups, and H- and epoxy-functional $C_{8-18}$-alkyl-methyl-polysiloxane containing additional aryl groups, or a combination thereof, said polysiloxane comprising 25 to 40% of said dispersion.

2. A finishing agent in accordance with claim 1, wherein mixtures of perfluoroaliphatic group-bearing water and oil repellent compound comprise component A.

3. A finishing agent in accordance with claim 1, wherein said dispersion A) contains 5.5 to 15% by weight fluorine.

4. A finishing agent in accordance with claim 1, wherein the emulsified oxidized polyethylene in component B) has a density of 0.95 to 1.05 g/cm$^3$, an acid number of 10 to 60 and a saponification number of 15 to 80.

5. A finishing agent in accordance with claim 1, wherein component B) further comprises an emulsifier in amounts to at least 3% by weight, based on the weight of the polyethylene wax.

6. A finishing agent in accordance with claim 1, wherein component B) comprises 20 to 35% by weight of said finishing agent.

7. A finishing agent in accordance with claim 1, wherein component C) comprises mixtures of soft-hand extenders comprising hydrogen alkyl polysiloxane.

8. A finishing agent in accordance with claim 1, wherein component C) comprises 25 to 35% by weight of said finishing agent.

9. A finishing agent in accordance with claim 1, wherein component B) further comprises an emulsifier in an amount of 8 to 40% by weight, based on the weight of the polyethylene.

10. A process for providing fibrous materials with a soft hand water and oil repellent treatment comprising contact said fibrous material with an aqueous bath containing 40 to 100 g/l of a finishing agent, said finishing agent containing about 25 to 35% by weight solids and comprising A) 25 to 65% by weight, based on the weight of the finishing agent, of an aqueous dispersion of a fluoroaliphatic group-bearing water and oil repellent compound selected from perfluoroaliphatic group-bearing polyurethanes, perfluoroaliphatic group-bearing N-methylol condensation products, perfluoroaliphatic group-bearing polycarbodiimides, perfluoroaliphatic group-bearing polymer or copolymer, perfluoroaliphatic group-bearing guanidines, perfluoroaliphatic group-bearing allophanates, perfluoroaliphatic group-bearing biurets, or combinations thereof, said compound comprising 30 to 55% by weight of said dispersion and said dispersion containing at least 5% by weight fluorine, B) 10 to 35% by weight, based on the weight of the finishing agent, of an aqueous dispersion of an emulsified oxidized polyethylene with a density at 20° C. of at least 0.92 g/cm and an acid number of at least 5, said emulsifiable polyethylene comprising 20 to 35% of said dispersion, and C) 25 to 40% by weight, based on the weight of the finishing agent, of a 25 to 40% fluorine-free aqueous dispersion of a soft-hand extender hydrogen alkyl polysiloxane selected from the group consisting of an H-functional $C_{8-18}$-alkyl-methyl-polysiloxane, an H- and epoxy-functional $C_{8-18}$-alkyl-methyl-polysiloxane, an H-functional $C_{8-18}$-alkyl-methyl-polysiloxane containing additional aryl groups, an H- and epoxy-functional $C_{8-18}$-alkyl-methyl-polysiloxane containing additional aryl groups, or a combination thereof, said polysiloxane comprising 25 to 40% of said dispersion, and drying the treated fibrous material.

11. A process in accordance with claim 10, wherein said bath further comprises 10 to 45 g/l of a 40 to 60% solution of an aminoplast resin.

12. A process in accordance with claim 10, wherein said bath further comprises textile auxiliary agents.

* * * * *

UNITED STATES PATENT AND TRADEMARK OFFICE

CERTIFICATE OF CORRECTION

PATENT NO. : 5,047,065

DATED : September 10, 1991

INVENTOR(S) : Hans-Burkhardt Vogel, Frans Mosch, Erich Karl Rossler, Dr. Michael Alexander Bernheim, Johan Emiel DeWitte and Rudolph Jozeph Dams It is certified that error appears in the above-identified patent and that said Letters Patent is hereby corrected as shown below:

Col. 8, line 32, "spectrum A" should read --spectrum. A--

Col. 13, line 4, delete "wax" at end of line.

Signed and Sealed this

Eighteenth Day of January, 1994

Bruce Lehman

*Attest:*

BRUCE LEHMAN

*Attesting Officer*

*Commissioner of Patents and Trademarks*